US007938461B2

(12) United States Patent
Ollinger

(10) Patent No.: US 7,938,461 B2
(45) Date of Patent: May 10, 2011

(54) DOOR STOP DEVICE

(76) Inventor: Leslie Ollinger, Grinnell, IA (US)

( * ) Notice: Subject to any disclaimer, the term of this patent is extended or adjusted under 35 U.S.C. 154(b) by 0 days.

(21) Appl. No.: 12/155,011

(22) Filed: May 28, 2008

(65) Prior Publication Data

US 2008/0309100 A1 Dec. 18, 2008

Related U.S. Application Data

(63) Continuation-in-part of application No. 11/406,376, filed on Apr. 19, 2006, now abandoned.

(51) Int. Cl.
*E05C 17/44* (2006.01)
*E05C 17/54* (2006.01)

(52) U.S. Cl. ..... 292/338; 292/339; 292/DIG. 15; 16/82

(58) Field of Classification Search ..... 292/338, 292/339, DIG. 15
See application file for complete search history.

(56) References Cited

U.S. PATENT DOCUMENTS 1,064,320 A * 6/1913 Glindkamp ..... 292/339
2,709,615 A * 5/1955 Barnes, Jr. et al. ..... 292/339
4,883,297 A * 11/1989 Smith ..... 292/339
5,098,138 A * 3/1992 Vandewege ..... 292/66
5,286,075 A * 2/1994 Monzingo ..... 292/339
5,653,487 A * 8/1997 Proni ..... 292/288
5,787,548 A * 8/1998 Tzen ..... 16/82

* cited by examiner

*Primary Examiner* — Carlos Lugo
(74) *Attorney, Agent, or Firm* — Klima Law Offices, PLLC

(57) ABSTRACT

A door stop device including a handle provided with a pivoting leg. The door stop device according to the present invention is configured to preferably minimize a user bending over to install or remove the door stop device, or more preferably eliminate the user bending over to install or remove the door stop device.

19 Claims, 2 Drawing Sheets

DOOR STOP DEVICE

CONTINUING INFORMATION

This application is a continuation-in-part of U.S. Patent Application entitled "Door Stop Device", application Ser. No. 11/406,376, filed on Apr. 19, 2006 now abandoned.

FIELD OF THE INVENTION

The present invention is directed to a door stop device, preferably a portable door stop device.

BACKGROUND OF THE INVENTION

There exist a number of different types of door stops configured to maintain a door in an open position. For example, there exists a stand alone rubber wedge-shaped door stop that can be wedged between the floor and the lower edge of the door to maintain the door open. Further, there exists a door stop that is permanently mounted to the bottom of the door (i.e. not portable), and stays with the door throughout the life of the door.

There exists a need for an improved door stop device, in particular a portable door stop device to facilitate cleaning and maintenance of commercial or institutional buildings. In a preferred embodiment, the door stop device can be easily and conveniently installed prior to cleaning, and then later removed after cleaning. Further, it is desirable that such a door stop can be installed and removed in a manner to minimize the user bending over during installation or removal. Even further, it is even more desirable that such a door stop can be installed and removed in a manner to eliminate the user bending over during installation or removal.

SUMMARY OF THE INVENTION

The first object of the present invention is to provide an improved door stop device.

A second object of the present invention is to provide an improved portable door stop device.

A third object of the present invention is to provide a door stop device having a substantially long handle to minimize the user bending over to install or remove the door stop device.

A fourth object of the present invention is to provide a door stop device having a substantially long handle to eliminate the user bending over to install or remove the door stop device.

A fifth object of the present invention is to provide a door stop device including a handle having a lower door gripping finger, and a pivotable leg portion configured to secure the door stop device from movement with the floor.

A sixth object of the present invention is to provide a door stop device including a handle having a lower door gripping finger combined with a pivotable leg portion, the leg portion being adjustable in length.

A seventh object of the present invention is to provide a door stop device including a bent handle portion having a lower door gripping finger, and a pivoting leg portion, the pivoting leg portion being a telescoping leg portion.

The present invention is directed to an improved door stop device, preferably an improved portable door stop device.

A preferred embodiment of the door stop device according to the present invention includes a handle portion provided with a pivoting leg. The handle portion is preferably an elongated (i.e. long) handle portion having an upper handle portion and a lower handle portion. The lower handle portion is provided with a lower door edge gripping portion (e.g. door gripping finger). In a preferred embodiment, the handle portion is bent so that the lower handle portion can be positioned flat against the side of the door, and the upper handle portion bends away from the door to facilitate gripping by a user. The lower door gripping portion of the handle, for example, can be a door gripping finger or extension provided at the lower end of the handle portion. For example, the handle portion is made of a flat metal strip, and a short finger portion (e.g. one-quarter inch to two inch) is made by bending the metal strip near the bottom thereof. The finger portion can be provided with a resilient plastic or rubber cover to enhance the frictional engagement with the lower edge of the door.

In a preferred embodiment, the upper handle portion is provide with or defines a hand grip for the user. The hand grip is preferable configured to allow a user's hand to grab the hand grip (e.g. user's hand wraps around the hand grip). For example, a user grips the hand grip with the user's thumb located on one side of the hand grip and the user's fingers on the opposite side of the hand grip. The upper handle portion can be configured to provide a hand grip, or a separate hand grip can be attached to the upper handle portion (e.g. rubber or plastic hand grip fitted over end of the upper handle portion).

The door stop device includes a pivoting leg connected to the handle portion. The pivoting leg is preferably adjustable in length so that the door stop device can accommodate different doors throughout a building having different size doors or different size gaps between the floor and a lower edge of the various door. A lower end of the pivoting leg is preferably provided with a rubber stop or cover to enhance the frictional grip of the lower end of the pivoting leg with the floor, for example, to facilitate locking the door stop device in place against the face of a door. In a preferred embodiment, the pivoting leg includes an upper U-shaped bracket connected to the back of the plate handle (e.g. by welding), and a pin passing through an upper end of the pivoting leg and the bracket to provide a pivoting connection therebetween. The leg portion can be made as to be telescoping to make it adjustable in length. For example, the leg portion can be made of a lower tubular section slidably disposed within an upper tubular section. The upper tubular section can be provided with a series of vertical through holes and the lower tubular section can be provided with a spring biased pin configured so as to lock in one of the through holes in the upper tubular section. In this manner, the length of the pivoting arm can be adjusted and then lock in place.

The door stop device according to the present invention can be made of metal, plastic, fiberglass, graphite, carbon, wood, wood filled, glass filled, composite, or other suitable material. In one preferred embodiment, the handle portion is made of a flat strip of aluminum plate.

In a preferred embodiment, a lower end of the aluminum strip is bent at approximately ninety degrees (90°) to form the door gripping finger or portion, and the metal strip is bent approximately ten degrees to forty-five degrees (10° to 45°) at or near the center thereof so that the upper handle portion of the metal strip extends away from the door when the door stop is installed up against the face of the door to facilitate a user gripping the upper handle portion of the handle portion. The upper handle portion is provided with at least one through hole for hanging the door stop from a wall or custodian cart. Further, to lighten the handle, the upper portion of the aluminum plate can be drilled with a plurality of through holes to reduce material and weight while still being sufficiently strong to serve as a handle. In this same embodiment, the pivoting leg can be made of an aluminum bracket, an upper aluminum tubing section, and a lower aluminum tubing section slidably disposed within the upper aluminum tubing section. A rubber foot can be provided at the bottom of the lower aluminum tubing section. The movable locking pin is preferably made of steel to increase the strength of the pivot connection.

Another preferred embodiment of the door stop device according to the present invention can be made of plastic material, in particular plastic resin. This embodiment can be made by injection molding a portion, or the entire door stop device. For example, the handle portion can be plastic injection molded as one piece, and the pivoting leg can be molded as two (2) separate piece assembled together as a telescoping leg. The assembled pivoting leg can then be assembled to the handle portion.

DETAILED DESCRIPTION OF PREFERRED EMBODIMENTS

A preferred embodiment of a door stop device 10 according to the present invention is shown in FIGS. 1-7.

The door stop device 10 includes a handle 12 provide with a pivoting leg 14. The handle 12 includes an upper handle portion 12*a* connected to a lower handle portion 12*b*. The pivoting leg 14 is configured to be a telescoping leg, and includes an upper leg section 14*a* and a lower leg section 14*b*. The lower leg section 14*b* is slidably disposed within the upper leg section 14*a*.

Figure 1:
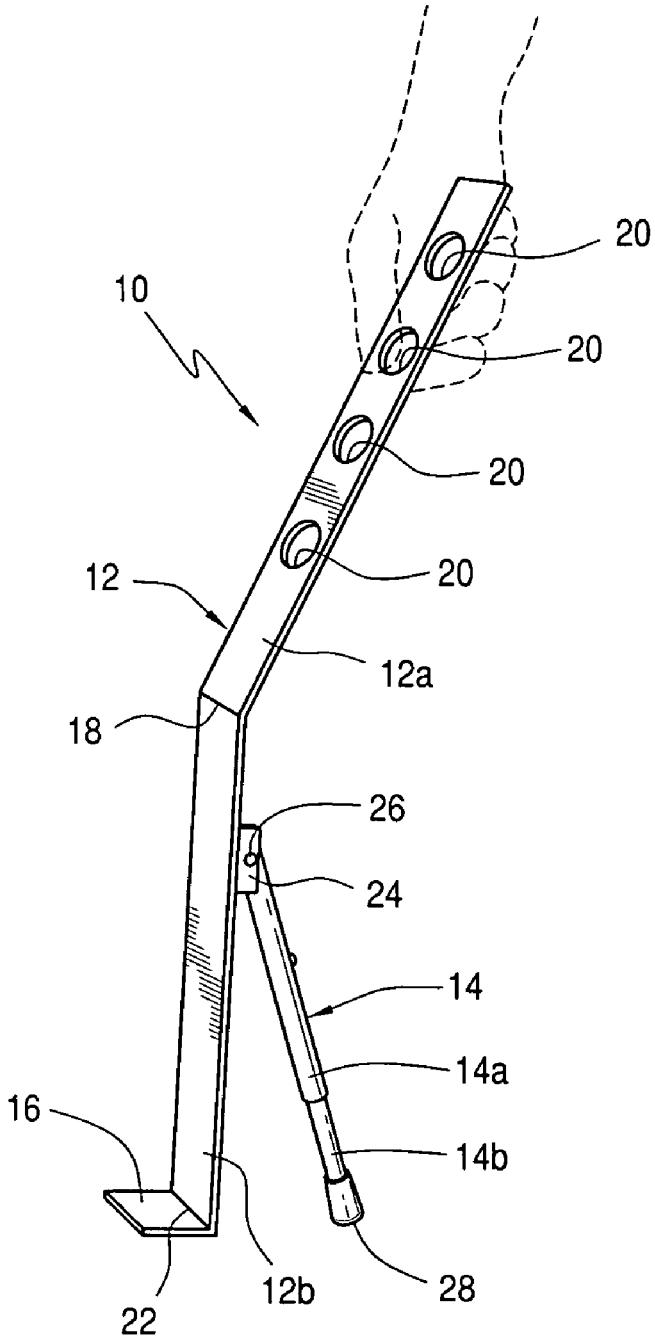
FIG. 1 is a perspective view of a preferred embodiment of the door stop device according to the present invention.
Figure 2:
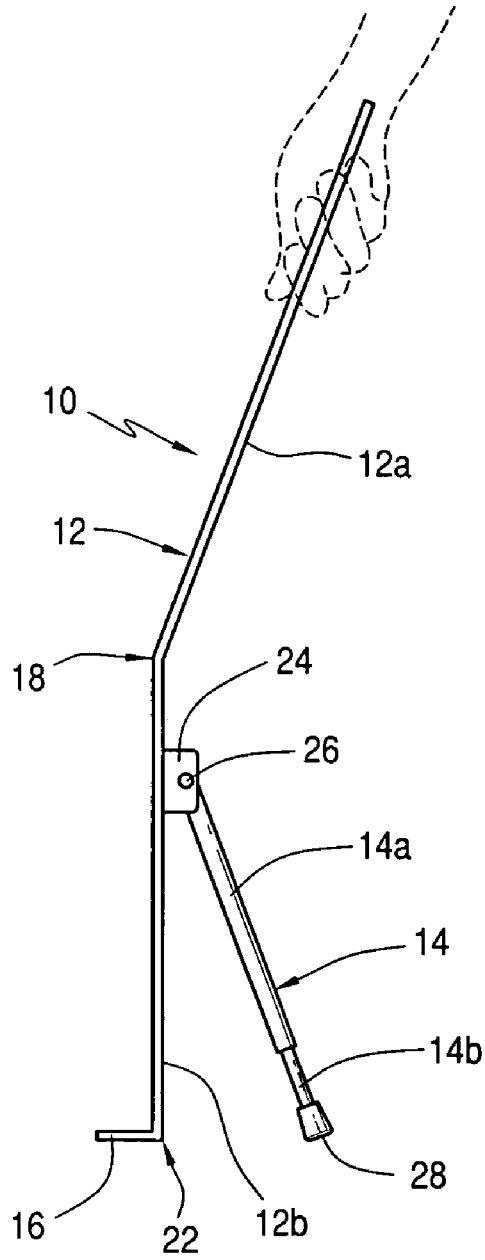
FIG. 2 is a side elevational view of the door stop device shown in FIG. 1.
Figure 3:
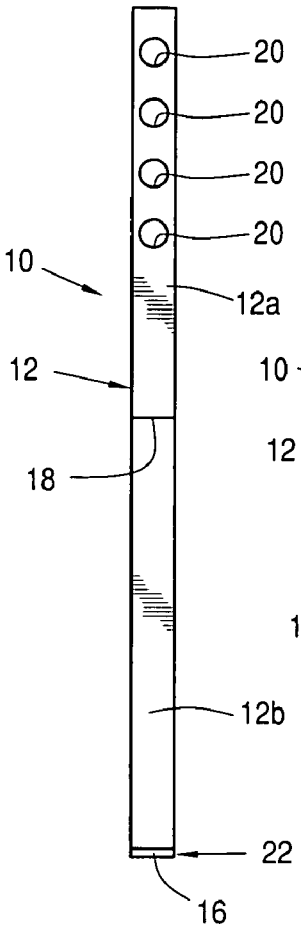
FIG. 3 is a front elevational view of the door stop device shown in FIG. 1.
Figure 4:
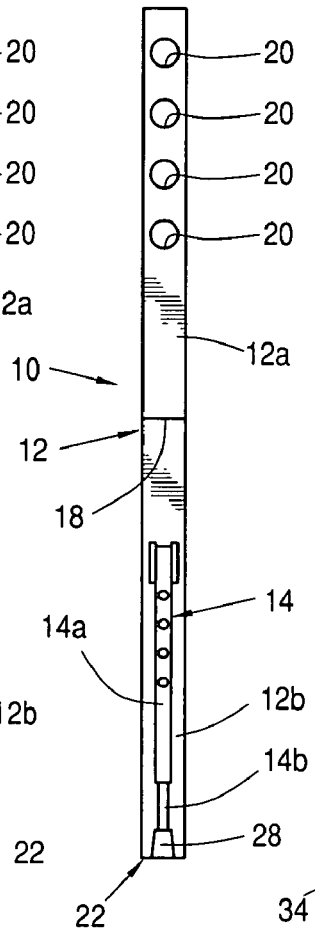
FIG. 4 is a rear elevational view of the door stop device shown in FIG. 1.

An upper portion of the upper handle portion 12*a* provides a hand grip for a user, as shown in FIGS. 1 and 2. Specifically, the upper handle portion 12*a* is configured to allow a user to grab the upper handle portion 12*a* with the user's hand. For example, the upper handle portion 12*a* is made slender enough in width to fit in the palm of the user's hand when gripping same. The plate type structure of handle 12 having a small thickness also allows the handle 12 to fit within a user's hand when gripping. In a preferred embodiment, the handle 12 is made long enough so that the user can grip and then install the door stop device in an operational position against a door or remove the door stop device from the door without the user substantially bending over. In a more preferred embodiment, the handle 12 is made long enough so that the user can grip and then install the door stop device in an operational position against a door or remove the door stop device from the door to eliminate a user bending over.

The handle 12 is provided with a door gripping finger 16 located at the bottom of the lower handle portion 12*b*. Further, the handle 12 is bent at axis or point 18 so that the upper handle portion 12*a* bends away from the door when the lower handle portion is placed against the door (See FIG. 6). The upper handle portion 12*a* is provided with at least one through hole 20 to hang the door stop device 10 from a wall, door or custodian cart. Further, the upper handle portion 12*a* is provided with additional through holes 20 to reduce the amount of material and the weight of the handle 12.

The handle 12 can be made of metal, plastic, fiberglass, carbon fiber, composite or other suitable material. For example, the handle 12 is made from a flat plate of aluminum cut to shape (e.g. aluminum strip), and bent at axis or point 18 so that the upper handle portion 12*a* bends away from the lower handle portion 12*b*. The aluminum plate is also bent at axis or point 20 (e.g. 90 degrees) to form the door gripping finger 16. Alternatively, the handle 12 is injection molded from plastic resin, in particular glass filled plastic resin to enhance strength, durability, and performance of the handle 12.

The pivoting leg 14 is connected to the handle 12 by a bracket 24 and pin 26 (FIG. 2). For example, the bracket 24 can be a U-shaped aluminum bracket bent from a strip from aluminum plate, and connected (e.g. welded) to the back of the handle 12. The bracket is drilled, and a pin 26 (e.g. steel pin) is inserted through both sides of the bracket 24 and secured in place (e.g. by forming head portions). The pin 26 serves as a pivot point for the pivoting arm 14 and in a preferred embodiment, the pivoting arm 14 freely pivots relative to the handle 12. In a preferred embodiment, the pivoting let 14 is a telescoping leg to adjust the length thereof to accommodate different doors or different clearances between the floor and the lower edge of different doors. The pivoting leg 14 is provided with a rubber foot 28 to resiliently grip the floor, and prevent slippage there between.

Figure 5:
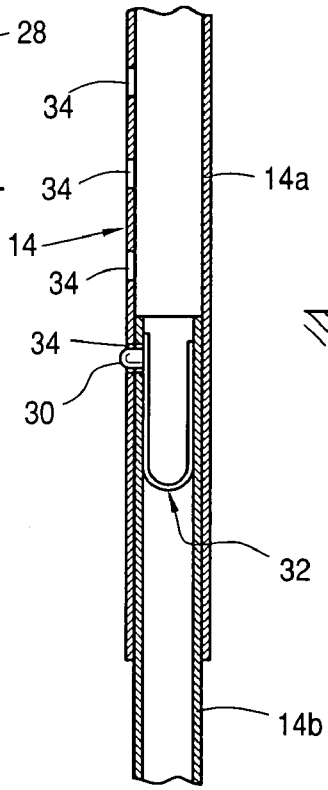
FIG. 5 is a partial broken away longitudinal cross-sectional view of a portion of the pivoting leg of the door stop device shown in FIG. 1.

For example, the pivoting leg 14 is made out of sections of aluminum tubing with the upper leg portion 14*a* having a larger diameter than the lower leg section 14*b* (FIG. 5). Specifically, the inner diameter of the upper leg section 14*a* is slightly greater than the outer diameter of the lower leg section 14*b* so that the lower leg section 14*b* can be slidably disposed within the upper leg section 14*a* and telescope therefrom. To provide a length adjustment, for example, a movable pin 30 mounted on a U-shaped spring 32 (FIG. 5) is disposed within the lower leg section 14*b*. The head of the pin 30 fits into one of four through holes 34 in the upper leg portion 14*a* to allow the length of the pivoting leg 14 to be adjusted to four (4) different lengths. The spacing and number of through holes can be adjusted or varied for different designs or different size door stop devices. Further, an alternative locking device can be used for securing the lower leg portion 14*b* within the upper leg portion 14*a*. The length of the pivoting let 14 can be adjusted by pushing inwardly on the head of the pin 30 until the upper leg portion 14*a* can slide relative to the lower leg portion 14*b*, and then allowing the head of the pin 30 to come through a different through hole 34 selected.

Alternatively, the bracket 24 is injection molded with plastic resin as part of the handle 12, and the pivoting leg sections 14*a*, 14*b* are injection with plastic resin as separate pieces, and then assembled together. The assembled pivoting leg is then assembled to the handle 12.

Figure 7:
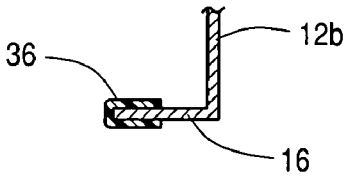
FIG. 7 is a broken away longitudinal cross-sectional view of the door gripping finger provided with a resilient cover.

As shown in FIG. 7, the door gripping finger can optionally be provided with a resilient cover 36 (e.g. made of plastic or rubber) to enhance the frictional engagement with the bottom edge of the door.

Figure 6:
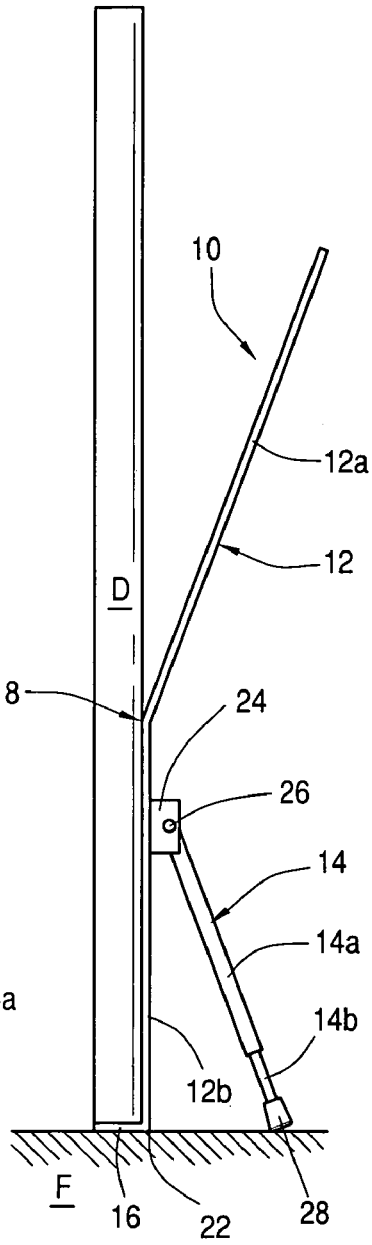
FIG. 6 is a side elevational view of the door stop device, shown in FIG. 1, in operation against a door.

During use, the user installs the door stop device 10 against the door D to be maintained open, as shown in FIG. 6. Specifically, the door gripping finger 16 is slid under the lower edge of the door D in the gap between the door and the floor F. The user pushes the handle 12 against the side of the door until the lower handle portion 12*b* is flat against the side thereof, as shown in FIG. 6. The user then pushes the pivoting arm 14 (e.g. with the users foot or toes) against the pivoting leg 14 until the rubber foot 28 firmly engages with the floor F causing the door gripping finger 16 to lift upwardly and firmly engage with the lower edge of the door D. In this manner, the door D is firmly secured in place from movement. To remove the door stop device 10, the user uses his or her foot or toes to push outwardly the pivoting leg 14 to release the grip by the door stop device 10 on the lower edge of the door D. The user then simply pulls the handle 12 away from the door D and lifts the door stop device upwardly.

The length of the handle 12, in particular the upper hand portion 12*a*, is sufficiently long so that the user preferably minimally bend, or more preferably does not have to bend, to install or remove the door stop device from the door D. In this manner, the door stop device 10 can be easily and quickly installed or removed with minimal effort and time by the user greatly increasing the convenience of the door stop device 10.

I claim:

1. A portable door stop device comprising:

an elongated handle including an upper handle portion connected to a lower handle portion, said lower handle portion extending substantially vertical when said door stop device is installed on the door, said upper handle portion extending upwardly and set at an angle extending away from the connection with said lower handle portion, said elongated handle configured so that said upper handle portion extends away from the door when said door stop device is positioned contacting the door to enable the user to grip said upper handle portion with the user's hand when said door stop device is being installed on or removed from the door, said upper handle portion positioned at a certain height from the connection with said lower handle portion to allow a user to install said door stop device on the door or remove said door stop device from the door without bending over;

a hand grip portion provided on an upper end portion of said upper handle portion, said hand grip configured to allow a user to grip said upper handle portion with the user's hand, and install said door stop device against a door, or remove said door stop device from the door;

a door gripping finger extending transversely from a bottom end of said lower handle portion, configured to firmly engage a bottom surface of the door when the door stop device is installed; and a pivoting leg connected to said lower handle portion for biasing said lower handle portion against the door during operation of said pivoting leg, said pivoting leg configured to be adjustable in length, said pivoting leg including a resilient end portion configured to enhance frictional engagement with a floor beneath the door being stopped by said door stop device.

2. A portable door stop device, comprising:

a flat elongated handle including an upper handle portion connected to a lower handle portion, said upper handle portion including a hand gripping portion extending upward and set at an angle extending away from the connection with said lower handle portion, said upper handle portion extends away from a door when the door stop is positioned contacting the door to enable the user to grip said upper handle portion with the user's hand when said door stop device is being installed on or removed from the door, said flat elongated handle bend at an end of said lower handle portion to provide a lower door edge gripping finger to firmly engage a bottom of said door when the door stop device is installed and the lower handle portion is against the door, said hand gripping portion is provided at an end of said upper handle portion, said hand griping portion is positioned away and at certain height from the connection of said upper handle portion and said lower handle portion to allow a user to install or remove said door stop device without bending over; and a pivoting leg connected to said lower handle portion below said upper handle portion, said pivoting leg configured to be adjustable in length, said pivoting leg including a lower leg section telescoping downwardly from said upper leg section, said pivoting leg including a resilient lower end configured to enhance frictional engagement with a floor beneath the door being stopped by said door stop device.

3. A door stop device, comprising:

an elongated flat handle including an upper handle portion and a lower handle portion, said upper handle portion extending upward and set at an angle extending away from the connection with said lower handle portion, said elongated handle configured so that said upper handle portion extends away from and a door and said lower handle portion contact the door surface when the door stop is installed against the door, said flat plate handle being bent at a bottom end of said lower portion to provide a lower door edge gripping finger, a hand grip portion is provided at an end portion of said upper handle portion, said hand grip portion located at a certain height from the connection between said upper handle portion and said lower handle portion to allow a user to grip said hand gripping portion and install and remove said door stop device to minimize or eliminate a user bending over during installation or removal of said door stop device, and a pivoting leg connected to said lower handle portion below said upper handle portion, said pivoting leg configured to be adjustable in length, said pivoting leg including a lower leg section telescoping downwardly from said upper leg section and a locking device for locking the length of said pivoting leg, said pivoting leg including a resilient lower end configured to enhance frictional engagement with a floor beneath the door being stopped by said door stop device, whereby said door stop device is installed by the user gripping said hand gripping portion and positioning said lower handle portion against the door and positioning said lower door edge gripping finger under a lower edge of the door and then lifting said door stop device so that said lower door edge gripping finger make contact with the lower edge of the door, and then pivoting said pivoting leg downward into contact with a floor to bias said lower door edge gripping finger upward against the lower edge of the door and lock said door stop device in an operating position.

4. A device according to claim 1, wherein said handle is a flat handle.

5. A device according to claim 4, wherein said flat handle is a flat metal plate.

6. A device according to claim 1, wherein said handle is bent in the middle thereof.

7. A device according to claim 4, wherein a lower end of said flat handle is bent to provide said door gripping finger.

8. A device according to claim 1, wherein said pivoting leg is a telescoping leg.

9. A device according to claim 8, wherein said pivoting leg includes an upper tubular section and a lower tubular section, said lower tubular section being slidably disposed within said upper tubular section to provide said telescoping leg.

10. A device according to claim 9, wherein said pivoting leg includes a locking device to lock said lower tubular section from movement within said upper tubular section to fix the length of said pivoting leg.

11. A device according to claim 10, wherein one said tubular section is provided with a series of different height through holes, and the other tubular section is provide with a spring biased locking pin configured to selectively engage one of said different height through holes to adjust the length of said pivoting leg.

12. A device according to claim 1, wherein a lower end of said pivoting leg is provided with a resilient foot covering said lower end to frictional engage the floor.

13. A device according to claim 1, wherein said pivoting leg includes a bracket connected to said handle, and a pin for securing the pivoting leg to said bracket.

14. A device according to claim 1, wherein said door gripping finger is provided with a resilient cover to enhance frictional engagement with a lower edge of a door being stopped by said door stop device.

15. A device according to claim 1, wherein said handle and said pivoting leg are made of metal.

16. A device according to claim 15, wherein said handle is made of plate aluminum metal and said pivoting leg is made of tubular aluminum metal.

17. A device according to claim 1, wherein said handle and said pivoting leg are made of plastic.

18. A device according to claim 17, wherein said handle and said pivoting leg are injection molded from plastic resin.

19. A device according to claim 18, wherein said handle and said pivoting arm are injection molded from plastic resin.

* * * * *